US005876512A

United States Patent [19]

Desormeaux et al.

[11] Patent Number: 5,876,512

[45] Date of Patent: Mar. 2, 1999

[54] METHOD AND APPARATUS FOR CLEANING PRESSURE VESSELS WHILE UNDER OPERATION

[76] Inventors: Thomas F. Desormeaux, P.O. Box 32007, Lafayette, La. 70593; Kenny Desormeaux, P.O. Box 32007, Lafayette, La. 70593-2007; Anthony Theriot, P.O. Box 32007, Lafayette, La. 70593; Paul Alexandrenko, 1500 Roper Rd., Scott, La. 70583

[21] Appl. No.: 726,664

[22] Filed: Oct. 7, 1996

Related U.S. Application Data

[60] Provisional application No. 60/009,601 Jan. 14, 1996.

[51] Int. Cl.[6] ..... B08B 9/093

[52] U.S. Cl. ..... 134/22.18; 134/22.19; 134/23; 134/24

[58] Field of Search ..... 134/22.18, 22.19, 134/23, 24

[56] References Cited

U.S. PATENT DOCUMENTS

| | | | |
|---|---|---|---|
| 3,645,452 | 2/1972 | Stoeckel et al. | 239/227 |
| 4,146,044 | 3/1979 | Dow | 134/104 |
| 4,828,625 | 5/1989 | Moran | 134/22.18 |
| 4,945,933 | 8/1990 | Krajicek et al. | 134/167 R |
| 5,078,799 | 1/1992 | Matter et al. | 134/22.18 |
| 5,445,173 | 8/1995 | Aiken | 134/167 R |
| 5,460,331 | 10/1995 | Krajicek et al. | 239/263.3 |

*Primary Examiner*—Scott W. Houtteman
*Attorney, Agent, or Firm*—Garvey, Smith, Nehrbass & Doody, LLC

[57] ABSTRACT

A method for excavating solid materials within a pressurized storage tank by inserting a flexible lance under pressure within an outlet of the tank, the lance sealed off so that pressure is maintained in the tank, and flowing a pressurized fluid into the storage tank to excavate the solid material from the tank by allowing the material to be sucked out of the outlet port of the tank for collection. The method also includes flowing water under pressure adjacent the exit port for affecting a greater suction on the solids and providing a fluid medium for the solids to easily flow from the tank. The system which undertakes the method of the present invention may be utilized on a skid so as to make the system occupy less space when utilized on the rig floor.

23 Claims, 5 Drawing Sheets

METHOD AND APPARATUS FOR CLEANING PRESSURE VESSELS WHILE UNDER OPERATION

SPECIFICATION

This application is based in part on U.S. provisional patent application Ser. No. 60/009,601, filed on Jan. 14, 1996, entitled "Method and Apparatus for Cleaning Pressure Vessels While Under Operation", by the same inventors. Applicants request that the contents of that application be incorporated hereunto by reference thereto.

BACKGROUND OF THE INVENTION

1. Field of the Invention

The system and method of the present invention relates to cleaning of tanks. More particularly, the present invention relates to a system of cleaning solids and liquids which have accumulated in tanks, particularly of the type for collection of residue from a downhole drilling operation, wherein the solids in the tank care excavated through high pressure/high volume fluid injection, and are retrieved from the tank while the tank continues to be in operation under high pressure or low pressure (1440 psi—ambient) while the tank remains closed and sealed.

2. General Background

In the drilling and production of oil, the production platform includes all offshore or land production vessels, which receive the salt water, oil and gas condensate and sand, from the downhole production, for collection in the tank. However, during collection, the tank, over time, will accumulate a great quantity of solid materials such as sand, paraffin and other solids, which collect within the tank, and although the fluids such as the oil and water may be siphoned from the tank, the solids which accumulate often fill the entire tank, which after awhile, must be cleaned from the tank in order for the tank to be usable or function at full capacity. Currently, in order to do this, production must be shut off to the vessel or vessels to be cleaned on a platform, and the platform must be shut down, perhaps for days at a time, while the solids are being removed from the tank, to return it into use. If, for example, a platform is producing 10,000 to 30,000 barrels of oil a day, one can imagine the considerable cost of having to shut the platform down and the loss of revenues involved while this operation is going forward, even if there is a temporary loss of production. Also, current methods of cleaning involve cleaning manually with trained personnel making a "confined space entry" which can be dangerous, considering toxic components sometimes are present in the vessels. Most of the time, the vessel is entered through a man-way hatch, but cannot be entered in any other opening to the vessel. Therefore, there is a need in the industry for a system and a method for cleaning the tanks on a platform, whereby the solid materials which have accumulated in the tank can be cleaned while the tank continues to be in operation under high pressure, and there is little or no time lost during the cleaning process.

SUMMARY OF THE PRESENT INVENTION

The method and system of the present invention solves the shortcoming in the art in a simple and straightforward manner. In the principal embodiment, there is provided a tank through which fluids are flowing under high or low pressure; a connection member which can be secured to an opening in the tank; a nozzle member such as a lance spray nozzle insertable into one leg of the Y connection, for allowing fluid flow therethrough in a sealed configuration; a high pressure/high volume pump means pumping fluid under pressure into the spray nozzle, for injecting through the Y connection and into the pressurized tank; the fluid flowing into the tank under high pressure and high volume serving to break up any solids and/or slurries contained within the tank for allowing the matter to flow from the tank through a second leg of the Y connection providing a valving member for reducing the pressure of the fluid/solids cleaned from the tank; passing the fluid/solid mixture through a centrifugal pump, shaker system for reducing the solids contained within the fluid; flowing the fluids into a volume tank and returning the fluid to the high pressure/high volume pump to be recycled therethrough.

In additional embodiments, the method for excavating the solid materials within the storage tank may include the steps of inserting a flexible lance under pressure within an outlet of the tank, the lance sealed off so that pressure is maintained in the tank and flowing of pressurized fluid into the storage tank for excavating the solid material from the tank; allowing the material to be sucked out of an outlet port of the tank for collection and separation from the fluid. The method may include flowing water under pressure adjacent the exit port for affecting a greater suction on the solids flowing therefrom and providing a fluid medium for the solids to easily flow from the tank.

Therefore, it is a principal object of the present invention to provide a method for cleaning solid/fluids from a tank, while the tank may be under high pressure and is continue to be in operation;

It is a further object of the present invention to provide a method of introducing fluid under high pressure into a tank which is in operation, so that the fluid may break up solids or the like collected within the tank, and the solid/liquid phase may be removed from the tank and separated therefrom so that the fluids may be recycled as high pressure cleaning fluid;

It is a further object of the present invention to provide a system for cleaning tanks, while the tank is in operation and under high pressure, without adversely affecting the operation of the tank, yet allowing solids which have been collected within the tank to be dislodged and removed from the tank in a fluid medium, so that the solids may be separated from the fluid at later stages in the process and the fluid may be recycled into the tank as the high pressure cleaning fluid.

It is a further object of the present invention to provide a method of solids separation to assist in separating the solids and undesirables from the fluid and solids being extracted from a tank/vessel, accomplished with a screen filter separation/shale shaker or configuration type process, whereby solids and undesirables are separated and extracted from the entire solution and then pumping the remaining cleaned fluid back into the vessel or to another vessel.

It is a further objection of the present invention to provide a method for cleaning a tank which is on line, by providing a transport means for oil/production to pass through the online system, thus enabling oil/gas production to flow onto an additional down line processor tank or other system.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
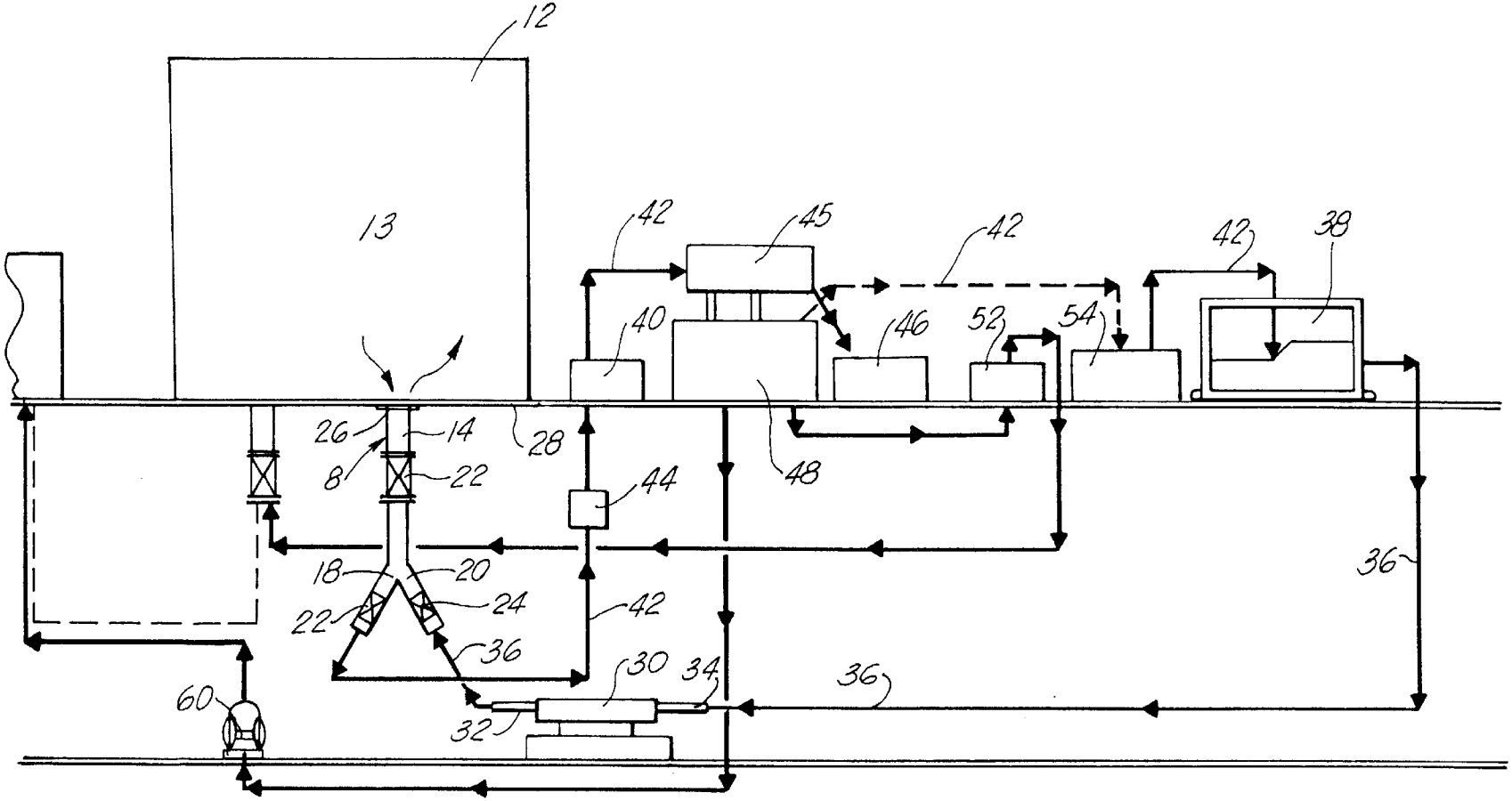
FIG. 1 is an overall view of the system utilized in undertaking the preferred embodiment of the method of the present invention.

FIG. 1 illustrates the preferred embodiment of the method of the present invention and the components of the system which may be utilized in order to carry out that method. As seen in FIG. 1, there is illustrated a tank 12, having a continuous sidewall 15, and defining an interior space 13 therein, with at least one inlet and one outlet for allowing fluid to flow therethrough during operation. Tank 12 may be of the type that is utilized in the oil field or in any other setting, which may have a high flow of fluid therethrough during use of the tank, and may be operated under high pressure.

Normally this type of tank 12 after a period of time of being on line, would have a certain amount of settlement and other materials which may be in solid form caked to interior of the wall 15 of the tank, or may be in slurry form collected in the bottom of the tank. Having this type of material in such a tank is undesirable, and therefore the method of the present invention, together with the components utilized therewith, could undertake to clean the tank interior.

What would be provided to cry out the method of the present invention, as seen in FIG. 1, is a first Y connection 14 having a principal leg 16 and a left leg 18 and right leg 20, each of the legs 18 and 20 converging into the principal flow leg 16 as illustrated. As further illustrated, there would be a valving member 22 on both legs 18 and 20, and a valving member 22 on the principal leg 16 in order to control flow of the fluid through the legs as desired during the process. In the preferred embodiment, the principal leg 16 of Y connection 14 would be secured to a flange 26 positioned on the lower portion 28 of tank 12, which would in most cases be positioned on a drain port of tank 12. However, it should be noted that in some instances, the Y connection 14 may be attached to a site glass inlet which would normally be positioned on the side wall 15 of the tank 12. In any event, the Y connection 14, when attached to the flange or to the site glass, would allow a fluid flow connection between the Y connector 14 and the interior 13 of the tank 12. Further, it should be noted that in the preferred embodiment, tank 12 would have a valving member positioned between the flange 26 and the tank 12 so that the valving member may shut fluid flow into the flange 26 from the interior 13 of tank 12, so that the Y connection 14 may be secured thereunto.

As a precaution, under the method of the present invention, because tank 12 may be under pressure anywhere between a pressure of 1,000 to 4,000–5,000 psi, it would be better that the Y connection 14, once it is secured, be tested with a sufficient amount of pressure that would be found in the interior 13 of tank 12, so that the operator is assured that the connection mechanism can withstand at least the pressure within tank 12. Following the connection of Y member 14 thereunto, there is further provided a lance spray nozzle 30 which is the type of spray nozzle that may be known in the art, and may be the type that will be disclosed in the alternate embodiment and will be discussed in detail in FIGS. 2 and 3 of the present patent. In any event, the lance spray nozzle 30 would further include a lance member 32, which would be inserted into, for example, the leg 20 of Y connector 14, through the valving member 24. In inserting the lance 32 therethrough, it is required that there be a fluid type connection around the exterior wall of lance 32 so that fluid cannot flow therefrom but can only flow in the direction into tank interior 13. The rear end 34 of lance spray nozzle 30 would be receiving a flow line 36, which would accommodate fluid flow from a high pressure/high volume pumping member 38, as seen in FIG. 1. The high volume/pressure pumping member 38 must be of sufficient strength in order to pump fluid, whether it be water, diesel fuel, or whatever type of cleaning fluid, under sufficient pressure, to utilized in cleaning out a particular tank 12. That is, it is critical that the fluid within line 36 flowing through spray nozzle 30 be under a pressure greater than the pressure within the tank 12, so that the fluid flowing through line 36 out of nozzle 32 and into the interior 32 of tank 12 can overcome the pressure within the tank and flow thereunto. It would be impossible for cleaning fluid to be introduced into the interior 13 of tank 12 if in fact the pressure within the tank were greater than the pressure within the flow line 36.

At that point in the method, once the fluid has been introduced under pressure into the interior of tank 12, then the fluid would begin to break apart the solids, whether it be silt, paraffin or other types of material, lodged within the tank so that it would mix with the fluid in the vessel and could be retrieved therefrom. At this step in the method, there is provided a centrifuge pump 40 which is connected via an exit flow line 42 into the second Y leg 18 of Y connector 14. Flow line 42 would receive the solids contained within the fluid flowing from the interior 13 of tank 12, through the second leg 18 of Y connector 14, as illustrated in FIG. 1. However, it should be noted that the fluid which is flowing from the interior 13 of tank 12 is of equal pressure as the fluid within the tank. Therefore, in the event that the pressure within the tank is high, such as 3,000–4,000 psi, it would be undesirable to maintain the fluid with pressure within flow line 42 at that high magnitude. Therefore, there may be incorporated a choke valve 44 within line 42 so that the pressure of the fluid can be greatly reduced as it is flowed into the centrifuge pump 40.

Following the flow of the fluid and solids through centrifuge pump 40, flow line 42 would continue to a series of separator and collection apparatuses, most of which are known in the art. In the preferred embodiment, as illustrated in FIG. 1, following the flow of the fluid/solid components through the first centrifuge pump, the fluid would flow via line 42 into a D.S./D.S. shaker system 45. In this system, the solids would be separated from the fluids, and if there were sand collected, it would flow into the sand box 46, and the fluids and other solids would flow into the bottom of the shaker system collection tank 48. The fluid would then be pumped via an additional centrifuge pump 52 via line 42 into a volume tank 54. This volume tank would hold the fluid which would be substantially free of most solids, where the fluid would be circulated via line 42 into the high pressure high volume pump 38 so that it can then be recirculated via original circulation line 36 flowing into the lance 30 and being recirculated through the process. It is through this closed loop process that the cleaning fluid is able to substantially be recirculated under pressure until the tank is completely cleaned.

It is foreseen that lance 30 which would be inserted into the leg 20 of Y connector 14, is doing so under extremely high pressure. In most cases, in the method of the present invention, the lance would be assisted into the high pressurized line via a hoist, so that approximately 3,000 lbs. of pressure would be needed in order to push the lance into the tank similar to a needle being forced through a substantially solid layer. Of course, after the lance is inserted therein, there would be a mechanism for locking the lance in place so that when the pressure from the tank so that when it would confront the pressure of the tank, it would not be forced out of engagement within line 20 and would be utilized in the method of the present invention.

Turning now to another aspect of the present invention, there is illustrated an air diaphragm pump 60. This type of air diaphragm pump 60 would be utilized in order to remove some of the fluid from the interior 13 of tank 12 through a second drain port other than through draining it through Y leg 18 as was discussed earlier. In order to provide that tank 12 be maintained in operation while it is being cleaned, often the manifold must have been removed and a temporary piping from one of the hoses can be established to the next vessel down line so that the production can continue while the cleaning process is ongoing. Therefore, the cleaning is undertaken while the vessel is on line and production does not have to be shut down.

In some instances, it should be noted that because of the type of material contained within the tank, the cleaning fluid, whether it be water, diesel or other fluid, must be heated to a certain amount in order to remove the collected solids. For example, quite often the solids collected in the tank will be paraffin. Due to the fact that paraffin does not become a flowable substance until substantially 300 degrees fahrenheit, it may be necessary that the cleaning fluid being flowed within the tank be at least 180 degrees fahrenheit and in some cases up to at least 300 degrees fahrenheit depending on the amount and nature of the paraffin contained therein.

Figure 2:
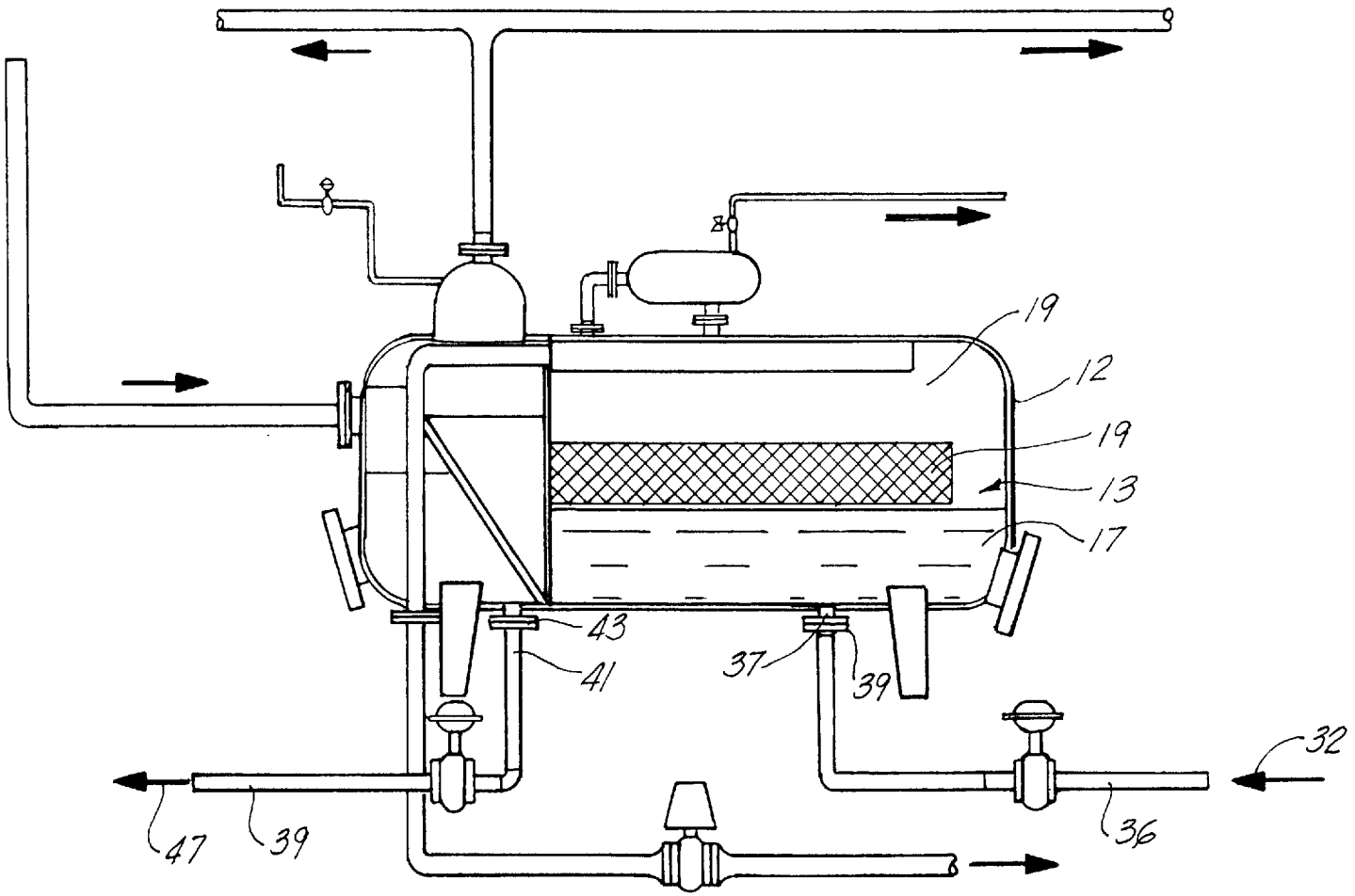
FIG. 2 illustrates an additional embodiment of the system of the present invention.

FIG. 2 illustrates an additional embodiment of the method of the present invention utilized in a particular type of setting. As seen in FIG. 2, there is illustrated a tank 12 which as seen in FIG. 2 is in its most optimum operating conditions, i.e. there is no solid material yet formed in the tank, but the tank would include a volume of water 17 within the lowermost portion of its interior 13, and a layer of the lighter hydrocarbon such as oil 19 in the uppermost portion of the tank, which would be naturally separated during operation. This particular type of tank may be a tank which would be using, for example, an electric grid 21 for separating the oil from the water, but it may be one of the types of tanks that may use baffles, or other interior components for separating the oil from the water. In any event, despite the type of tank being utilized, eventually material such as sand or other debris may collect on the lower portion of the tank which would displace the area that would normally be occupied by the water 17, and would have to be cleaned out.

The reason that this particular type of tank is particularly addressed in FIG. 2 is the fact that the tank would allow the insertion of the lance member 32 into the flow line 36 and into an entry port 37 at flange connection 39. Rather than have the Y connection 14 as seen in the principal embodiment, there would be an outflow line 41 flowing from another portion of the bottom of the tank from the bottom of the tank 12, at flange connection 43 so that the sand or the like material which has been loosened by the lance inserted into line 36 as was discussed earlier, is able to be siphoned, vacuumed or pumped from tank 12 via line 39 in the direction of arrow 47 to the shakers or the like, again as in the principal embodiment. Therefore, the primary difference between this particular embodiment and the embodiment as illustrated in FIG. 1 is the fact that the entry port of the lance is not coterminous with the exit port of the loosened material that would be recovered from the tank during the cleaning operation.

It is foreseen however, that some tanks may not have any ports on the bottom wall of the tank but may only have these ports on the top wall of the tank. And in some instances, there may be a single port. That being the case, then it is foreseen that a single tube having a double flow line may be inserted into the upper port of the tank with one of the lines having the lance member for injecting fluid or the like into the tank for loosening the material and the second line in the flow tube being a line which would vacuum, siphon or pump the loose material out of the tank, both operations taking place within the same flow tube because of the fact that there is a single port for allowing the operation to take place.

Figure 3:
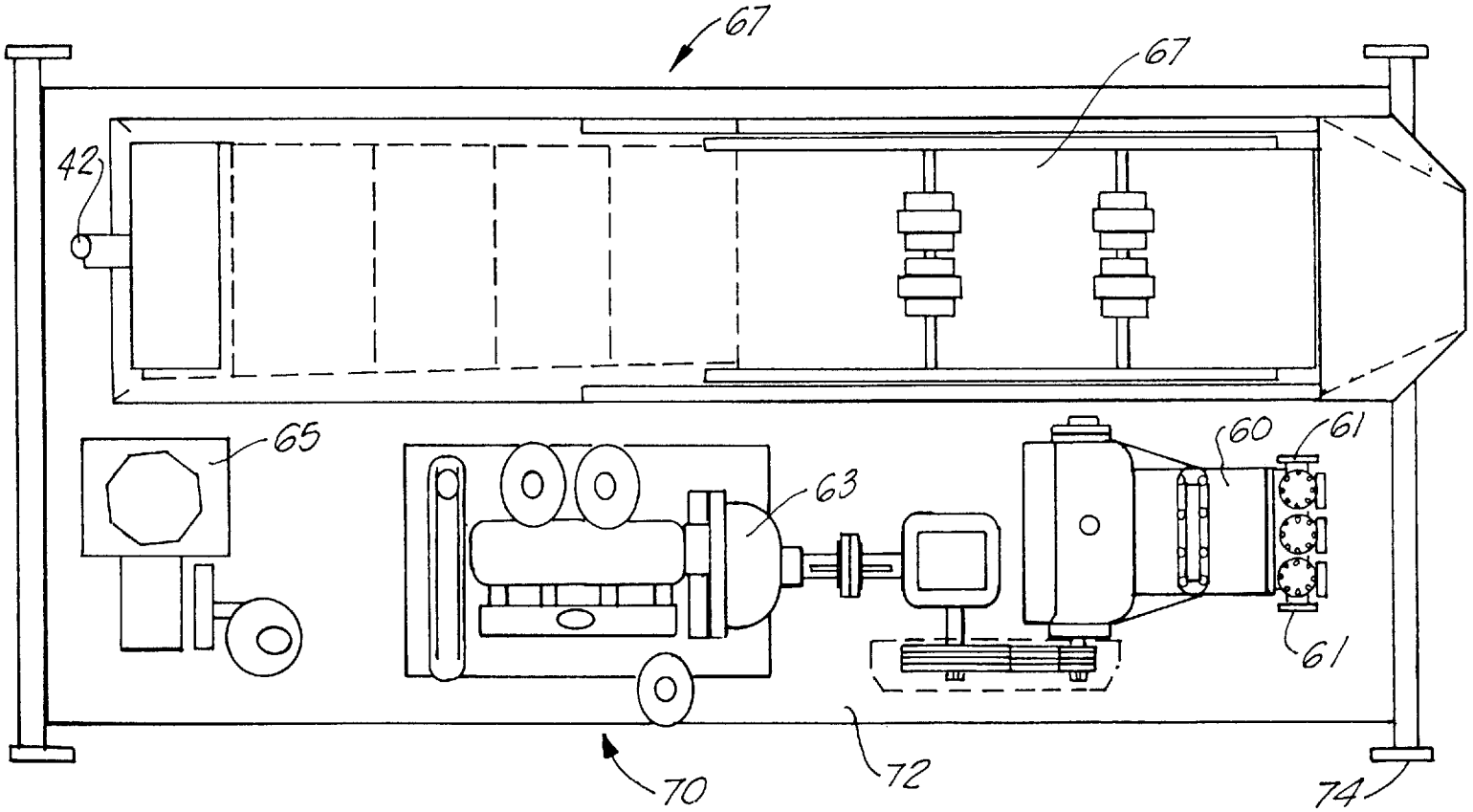
FIG. 3 illustrates a top view of the system of the present invention as it would be configured on a skid.

Turning now to FIG. 3, there is illustrated the system that is illustrated in FIG. 1, however the components of the system have simply been arranged onto a skid 70 of the type having a floor surface 72 and lifting arms 74 at each corner. Set upon the skid would be the pump member 60 with the outlets 61 to which the line 36 connecting to lance 32 would be attached at some remote point from the skid where tank 12 would be located. Further, there may be included on skid 70 the drive means or motor 63, which would operate pump 60, and there would also be included a generator 65 so that they system would be self-powered. Also positioned on the skid would be the collection system 67 which wold receive the flow line 42 from the tank which would contain the materials which have been loosened by the spray nozzle 30 of lance 32. Again, FIG. 3 would not add any new operational components to the system of the present invention, but simply illustrates the system placed upon a confined area such as a skid so that it could be easily used within a confined space such as an oil rig, upon which space is a premium, and could be easily lifted onto the rig and lifted off of the rig after completion of the work by the system.

Figure 4:
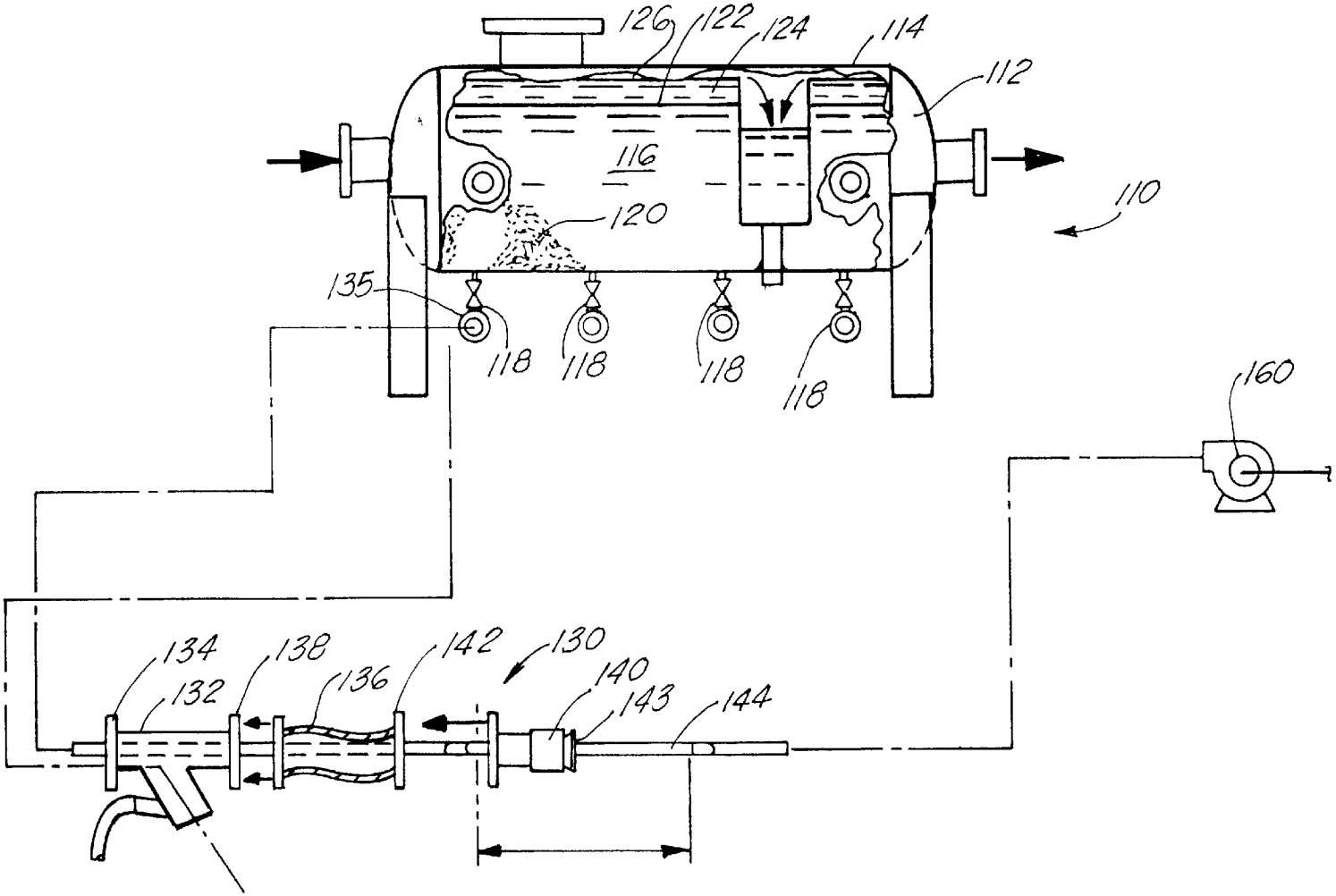
FIG. 4 illustrates an overall view of an alternate embodiment of the method of the present invention.
Figure 5:
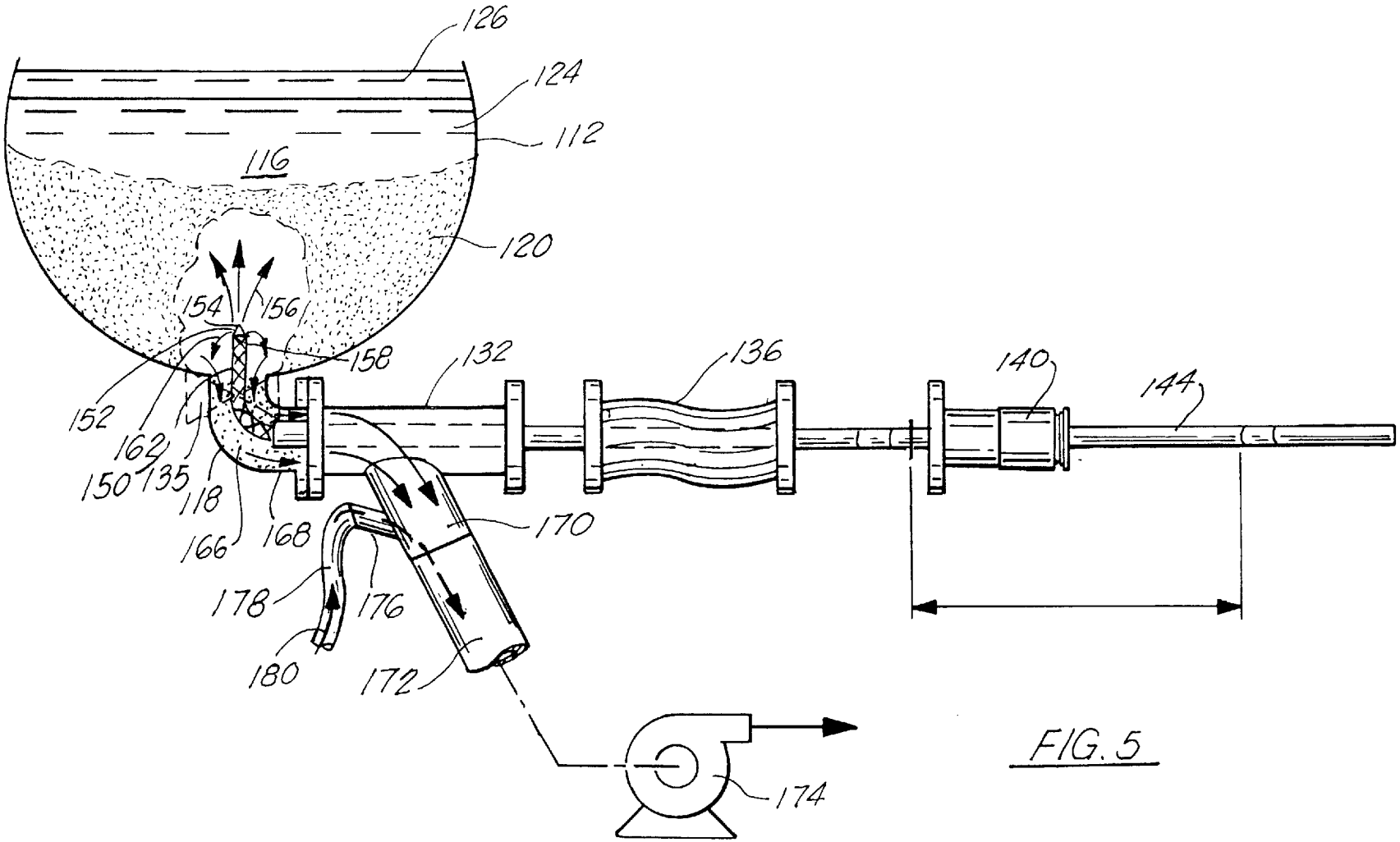
FIG. 5 illustrates an isolated view of the cleaning mechanism in the alternate embodiment of the method of the present invention.

What follows in a discussion of FIGS. 4 and 5 is an embodiment of the present invention which would utilize a particular type of nozzle positioned at the end of the lance spray nozzle, so as to achieve cleaning of the tank, and would incorporate a method of allowing an additional means for return of the fluid flow from the tank as the solid material is being dislodged therefrom.

While FIG. 1 illustrated the preferred embodiment of the system and method of the present invention, and FIGS. 2 and 3 illustrated an alternate embodiment in order to accommodate certain types of tanks, FIGS. 4 and 5 illustrate an alternate embodiment of the system and method of the present invention, as illustrated by the numeral 110. In FIG. 4 there is illustrated the basic components of the overall system that would be utilized in the present invention. The system would include a tank portion 112, having a continuous wall portion 114. The tank would be of the type described in FIG. 1, which is used as a collection tank on an oil and gas platform, to collect various fluids including salt water, etc., from downhole during the production of oil and gas. As further seen, the tank would be the type that could withstand high pressures during operation of the tank so that in effect, it would be a sealed chamber 116. There is further included a plurality of valved outlets 118 on the lower wall of the tank, for allowing materials to be drained therefrom.

As was stated earlier, one of the problems in the use of such a tank is the fact that solid materials such as sand and paraffin, designated in FIG. 4 by the numeral 120, collect in the bottom of the tank and may well occupy the greater portion of the tank up to, for example, line 122, leaving a very small portion 116 of the tank available for fluids, such as a layer of water 124 and a layer of oil 126 upon that. Therefore, the sand and paraffin material 120 must be cleaned from the tank.

While FIG. 1 showed the process utilized for cleaning the tank, FIGS. 4 and 5 offer additional components of the system, such as a mechanism 130 utilized for cleaning the tank once it becomes inoperable and filled with material. What is provided is an outer pipe member 132 which has a flanged end 134 which would flange to a flange 135 on first valve outlet 118 as seen in the FIGURE. There may be further included a length of flexible tubing 136 which is flangable onto a rear flange 138 of the outer pipe 132, and further include a stuffing box 140 which again would flange onto the rear flange 142 of the flexible tubing 136. The stuffing box 140 is generally known in the art and would include a central orifice 143 wherein a flexible lance 144 would be inserted through the bore 145 in stuffing box 140, and the stuffing box 140 would create a seal between the wall of the flexible lance 144 and the stuffing box 140 so as to maintain the pressure within the tank 112 during use of the system. The flexible lance 144 would then be inserted through the flexible tubing 136 through the outer pipe 132 and, upon opening of valved outlet 118, the flexible lance 144 would then move into the chamber 116 of the tank for the cleaning operation.

A more detailed view of this is seen in FIG. 5, where one of the valve outlets 118 has received the flexible member 150 through valve 135 after valve 135 has been placed in the open position. There is further seen the flexible lance 144 inserted through stuffing box 140 then into the flexible tubing 136, and then into the outer tubing 132 which has been flanged to the valved outlet 118 as seen in FIG. 5. As further illustrated, the flexible lance 144 may have on its end a flexible member 150 which would include a rotating nozzle 152 which is able to be inserted into the solid material 120 contained within the tank 112 as seen in FIG. 5. As an aside, as is illustrated, the material 120 again has a layer of water 124 and a layer of oil 126 above it while the operation may be going forward. It must be kept in mind also that the tank 112 is continuously under high pressure and does not have to be depressurized during this operation.

Returning now to the structure of the apparatus, the rotating nozzle 152 which is positioned at the first end of the flexible member 150 of lance 144, would be of the type having a first plurality of jets 154 which would direct water or other fluids such as oil or the like which would depend on the type of material being excavated from the tank in the direction of arrows 156. The fluid or the like which would be flowing under high pressure would be pumped through a bore in flexible lance 144 from a pump 160 as illustrated in FIG. 4. Furthermore, the nozzle 152 would provide a second set of jets 158 which, during rotation, would direct high pressure fluid flow in the direction of arrows 162 which would flow downward toward the inlet area of the nozzle as illustrated in FIG. 5. The combination of the nozzle jets 154, 158 of the orifices would first allow the high pressure spray in the direction of arrows 156 to begin the excavation process as seen in FIG. 5 in effect, boring out an area within the solid 120 as the process is ongoing, while the second set of jets 158 would direct pressurized fluid flow downward so that the solids 120 which are broken up by the fluid may not accumulate at the base of the inlet 118 which may make it difficult for retrieving the lance member 144 or for blocking the flow outward from the tank.

Once the solid materials have ben excavated, they would tend to fall to the bottom of the tank, and would be flowing out through the annulus 166 between the flexible tube 150 and the wall of the valved outlet 118 and would be directed rearwardly in the direction of arrow 168. The flow of the solids from the tank would be effected by a Y juncture 170 having a hose 172 leading therefrom and attached to a suction pump 174 as seen in FIG. 5. The suction affected by pump 174 would pull the solids from the tank through the annulus 166 and into Y juncture 170 and out through holes 172 to be collected and disposed of.

In order to enhance this operation, there is included a tube 176 which is formed in the wall of Y juncture 170, which would have a hose 178 attached thereto for introducing a fluid such as water under pressure in the direction of arrow 180 which would travel through tube 176 and would be returning and would flow down the bore of Y 170 into hose 172. This flow of the pressurized fluid in this manner would accomplish two things. First, it would create a greater suction effect for the materials to be sucked into Y 170 from tank 112 as the materials are being broken up. Secondly, it would create more of a slurry effect within the bore of Y 170 and within hole 172 as the solids flowed to be collected under vacuum.

Returning now to FIG. 4, it should be noted that tank 112, for example, includes 4 different valved outlets 118. As is illustrated in FIG. 4 as was discussed earlier, in this part of the process, the solid materials 120 have already been cleaned from three of the valved outlets 118, and the FIGURE illustrates the material 120 being excavated from the fourth valved outlet 118 in the process. Therefore, it is foreseen that when the tank is cleaned, each of the valved outlets would serve as a means for inserting the flexible lance 144 within the interior 116 of the tank and for excavating out that portion of the solid materials 120 of the tank. One would then move to the next valved outlet 118 in order to achieve excavation in that area until all four areas of the tank are cleaned which would in effect have the lower portion of the tank very well excavated. Often times when this is accomplished, there is a layer of solid material 120 left at the lower level of the water layer 124, and that solid layer 120 would then have to be broken up and excavated out also so the entire tank is cleaned.

Another feature of the present invention would include the fact that since the stuffing box 140 can receive any tube which would seal against the material contained therein, when the excavation is complete and the lance 144 is retrieved therefrom, one may wish to insert a flexible rod having a fiber optic camera on the end of it, and inserted into the tank for viewing of the inside of the tank after the cleaning process to assure that most, if not all, of the material has been excavated therefrom. The utilization of the RVI (remote visual inspection) method would allow that the inside of the tank be inspected while the tank 112 is continuously used and under pressure, and would not require that the tank be shut down and that any kind of manholes or the like be opened in order to view the interior of the tank.

It should be made clear that despite the components which may be utilized in cleaning tank 112 in this embodiment of tank 12 in the principal embodiment, the method for cleaning the tank would be generally the same. The cleaning method, in order to work in the optimum setting, must allow the tank to continue to be on line while being cleaned, and would it allow to be cleaned under high pressure, if necessary, so that tank service is not interrupted during the cleaning process.

The following table lists the part numbers and part descriptions as used herein and in the drawings attached hereto.

| Description | Part No. |
|---|---|
| tank | 12 |
| interior space | 13 |
| Y connection | 14 |
| side wall | 15 |
| principal leg | 16 |
| water | 17 |
| left leg | 18 |
| oil | 19 |
| right leg | 20 |
| electric grid | 21 |
| valving member | 22 |
| valving member | 24 |
| flange | 26 |
| lower portion | 28 |
| spray nozzle | 30 |
| lance member | 32 |
| rear end | 34 |
| flow line | 36 |
| entry port | 37 |
| pumping member | 38 |
| flange connection | 39 |
| centrifuge pump | 40 |
| outflow line | 41 |
| flow line | 42 |
| flange connection | 43 |
| choke valve | 44 |
| shaker system | 45 |
| sand box | 46 |
| arrow | 47 |
| collection tank | 48 |
| centrifuge pump | 52 |
| volume tank | 54 |
| diaphragm pump | 60 |
| outlets | 61 |
| motor | 63 |
| generator | 65 |
| collection system | 67 |
| skid | 70 |
| surface | 72 |
| arms | 74 |
| system | 110 |
| tank portion | 112 |
| wall portion | 114 |
| sealed chamber | 116 |
| valved outlets | 118 |
| solid material | 120 |
| line | 122 |
| water | 124 |
| oil | 126 |
| mechanism | 130 |
| outer pipe member | 132 |
| flange | 134 |
| flange | 135 |
| flexible tubing | 136 |
| rear flange | 138 |
| stuffing box | 140 |
| rear flange | 142 |
| central orifice | 143 |
| flexible lance | 144 |
| bore | 145 |
| flexible member | 150 |
| rotating nozzle | 152 |
| plurality of jets | 154 |
| arrows | 156 |
| second set of jets | 158 |
| pump | 160 |
| annulus | 166 |
| arrow | 168 |
| Y juncture | 170 |
| hose | 172 |
| suction pump | 174 |
| tube | 176 |
| hose | 178 |
| arrow | 180 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method for excavating solid materials from a pressurized multi-use tank, while the tank is on-line, comprising the following steps:

a) providing a valved flow line flangable to at least one outlet of the tank;

b) introducing a nozzle member into the flow line to a point so that the nozzle member is positioned within the interior of the tank while maintaining pressure within the tank;

c) providing a point of discharge adjacent the entry point of the nozzle member;

d) introducing a fluid flow through the nozzle under sufficient pressure to overcome the pressure in the tank and to break up the material within the tank and to create a reduced pressure area adjacent the point of discharge to enhance liquid/solid flow from the point of discharge; and e) flowing the fluid containing the solids from the point of discharge while the tank continues to be pressurized so that the fluids can then be separated from the solids after removal from the tank.

2. The method in claim 1, further comprising the steps of providing a high pressure/high volume pump for pressurizing the fluid before it is introduced into the tank.

3. The method in claim 1, further comprising the step of reducing the pressure of the fluid containing solids after it is removed from the tank so that the fluids may be separated from the solids under reduced pressure.

4. The method in claim 1, wherein the solids are removed from the fluid by flowing the mixture through at least a shaker system and returning the fluids, without solids, to the high pressure/high volume pump.

5. The method in claim 1, wherein the fluid being introduced into the pump under pressure may comprise water, diesel, oil or the like fluid.

6. The method in claim 4, further comprising passing the fluid/solid stream through a centrifuge pump, screen filtration system, and a volume tank, before the fluid is returned to the pump.

7. The method in claim 1, wherein the tank being cleaned will be maintained in operation during the cleaning method, to eliminate down time of the tank.

8. A method for excavating solid materials from a pressurized multi-use tank having multiple inlet ports, while the tank is on-line, comprising the following steps:

a) providing a valved flow line flangable to at least one in let of the tank;

b) introducing a lance spray nozzle into the inlet of the tank to a point so that the lance spray nozzle is positioned adjacent to or within the solid materials to be excavated from interior of the tank;

c) providing a point of discharge adjacent the entry point of the spray nozzle;

d) introducing a fluid flow through the lance spray nozzle under pressure greater than the pressure in the tank, to break up the solid material so that it will be part of the fluid within the tank, and to create a reduced pressure area adjacent the point of discharge to enhance liquid/solid flow from the point of discharge;

e) flowing the fluid containing the solids from the point of discharge of the tank so that the fluids can be separated from the solids after removal from the tank; and f) carrying out steps a) through e)while maintaining the pressure within the tank.

9. The method in claim 8, wherein the fluid flow introduced through the lance spray nozzle and flowed through the tank may be utilized as the carrying medium in the closed loop process a multiplicity of times.

10. The method in claim 8, further comprising the step of providing a high pressure/high volume pump for pressurizing the fluid before it is introduced into the lance spray nozzle.

11. The method in claim 8, further comprising the step of reducing the pressure of the fluid containing solids flowing from the tank so that the fluids may be separated from the solids under reduced pressure.

12. The method in claim 8, wherein the solids are removed from the fluid by flowing the mixture through at least a shaker system and returning the fluids, without solids, to the high pressure/high volume pump.

13. The method in claim 8, wherein the fluid being introduced into the pump under pressure may comprise water, diesel, oil or the like fluid.

14. The method in claim 12, further comprising passing the fluid/solid stream through other separator components, such as a centrifuge pump, and a volume tank, before the fluid is returned to the pump.

15. The method in claim 8, wherein the spray nozzle introduced into the tank may be controlled from the exterior of the tank for spot cleaning in a specific area within the tank.

16. The method in claim 8, wherein the tank being cleaned will be maintained in operation during the cleaning method, to eliminate down time of the tank.

17. A method for excavating solid materials within a pressurized multi-use tank, comprising the following steps:

a) providing a first outer pipe member flangable to at least one valved outlet of the tank;

b) providing a stuffing box having a bore therethrough for receiving a member within the bore to maintain the pressure within the tanks;

c) inserting at least one flexible lance through the stuffing box and through the outer pipe, so that the end of the flexible lance is insertable through the valved opening in the tank, said valve opening which may be located at some point around the exterior of the tank;

d) positioning a rotatable high pressure nozzle on the end of the flexible lance, so that fluid may flow through the nozzle under pressure;

e) providing a point of discharge adjacent the entry point of the high pressure nozzle;

f) inserting the flexible lance and nozzle into the solid material within the tank, so that the high pressure/high volume fluid from the rotating nozzle breaks up and excavates the material that the high pressure fluid comes into contact with and creates a reduced pressure area adjacent the point of discharge to enhance liquid/solid flow from the point of discharge;

g) providing a suction on the outer tube, for allowing the solid material to fall adjacent the point of discharge within an annulus between the outer tube and the flexible lance and be sucked through a juncture in the outer tube for collection or other opening in the vessel;

h) introducing flowing the solids/fluid material through a pressure reduction valve for reducing the pressure of the fluid flow, so that the solids within the fluid flow may be separated from the fluid after extraction from the tank;

i) carrying out steps (c) through (h) while maintaining the tank under pressure.

18. The method in claim 17, wherein the fluid flowing through the nozzle may be heavier in weight or chemically treated, and may be under a particular hot or cold temperature depending on the circumstances.

19. The method in claim 17, wherein the flexible lance and nozzle inserted into the tank may further comprise multiple lances and nozzles in order to more effectively clean the tank.

20. The method in claim 17, wherein the flexible lance and nozzle may further comprise high pressure/low volume lances for line cleaning following the entry of the lance and nozzle into the tank.

21. The method in claim 17, wherein there may be further provided a Venturi scrubber for scrubbing the materials as the materials exit the tank.

22. The method in claim 17, further providing the steps for introducing a flow of fluid into the outer tube for providing additional suction so that the solids excavated from the tank may be retrieved more easily, and for regulating the amount of volume and pressure extracted from tank and reducing temperature of material coming from tank by mixing it with the cooler liquid being introduced.

23. The method in claim 17 further comprising the step of reattaching the outer tube to other valved outlets of the tank and repeating the process until all of the solid material within the pressurized tank has been excavated therefrom. pressure.

* * * * *